United States Patent [19]

Rentmeester et al.

[11] 4,065,023

[45] Dec. 27, 1977

[54] CONTAINER AND METHOD OF FORMING

[75] Inventors: Kenneth R. Rentmeester, Barrington; John A. Jurcenko, Chicago; John D. Welks, Barrington, all of Ill.

[73] Assignee: American Can Company, Greenwich, Conn.

[21] Appl. No.: 635,152

[22] Filed: Nov. 24, 1975

[51] Int. Cl.[2] ..... B65D 7/34; B29D 23/10

[52] U.S. Cl. ..... 220/75; 113/120 K; 156/218; 220/81 R

[58] Field of Search ..... 113/8, 11 R, 11 A, 120 R, 113/120 A, 120 K, 120 U, 120 Y; 156/217, 218; 220/62, 63, 75, 81 R; 228/144; 161/214, 227

[56] References Cited

U.S. PATENT DOCUMENTS

| | | | |
|---|---|---|---|
| 2,799,610 | 7/1957 | Magill | 156/218 X |
| 3,713,409 | 1/1973 | Heniser | 113/120 K |
| 3,760,750 | 9/1973 | Rentmeester | 113/120 K |
| 3,773,589 | 11/1973 | Kaiser et al. | 156/218 |
| 3,898,945 | 8/1975 | Rohowetz | 113/120 A |
| 3,912,568 | 10/1975 | Veno et al. | 156/218 X |

*Primary Examiner*—Leon Gilden

*Attorney, Agent, or Firm*—Robert P. Auber; Ira S. Dorman; James B. Kinzer

[57] ABSTRACT

Tubular container bodies having a lap side seam, obtained by uniting a resin and an adhesive bondable therewith, are produced by applying the bonding resin to the limited lap area of body blanks moving in a continuous stream and applying heat to the limited lap area to cure the resin in less than one second; the resin may be so applied that the raw metal edge of the body blank is also coated. The resin may be subsequently reheated to the final state of cure in which it will bond to the tacky adhesive on the opposed lap margin of the body blank.

15 Claims, 5 Drawing Figures

CONTAINER AND METHOD OF FORMING

This invention relates to tubular containers having a lap side seam, such as those employed to package beverages and food products.

The type of container with which the present invention is concerned and its attendant commercial advantages are fully disclosed in U.S. Pat. No. 3,773,589. According to that patent the lap seam is securely bonded with a nylon type high strength organic adhesive at one lap margin, opposed to a bondable resin present as a size coating on the other margin of the lap seam.

When it is permissable to restrict the bondable resin size coating to the margin area of the lap seam this has been accomplished by roller stripe sizing a large sheet (say one about three feet square) with stripes of resin. Afterwards, the whole sheet is baked in an oven to cure the resin and then body blanks are cut therefrom, as many as thirty five body blanks each having the bondable resin along one lap margin. The bake consumes a lot of time and energy since the whole metal sheet must be raised to the cure temperature. The sheets are set on edge, separated and supported by wickets, and conveyed slowly through the oven. The wickets are returned for continuous cycling. The oven may be as long as 120 feet or more with a cross sectional area as much as 15 feet on a side. Large amounts of fuel are consumed.

To compensate for imperfections such as in the surface of the sizing roller, edge bleeding and undulation, the size coating is applied in a width and thickness considerably in excess of the area and amount required to insure a good bond with the cement (adhesive) at the opposed margin. The sheet to be sized has to be registered along one edge properly to locate the resin stripes, which heretofore have been about one inch in width as part of the compensating effort. There is difficulty in holding registration of so large a sheet.

The long baking time required to bring the whole sheet up to the resin cure temperature may discolor the resin size. If discoloration occurs and if the decorative coating invariably applied afterwards overlaps the discoloration, the aesthetic appearance may be altered by off-color shading resulting in rejects which diminishes productivity.

When the large sheet is cut, to obtain body blanks following the bake, raw metal is exposed at two parting lines. The raw edge metal (steel or aluminum) would be exposed to the contained product in the ultimate package and is therefore separately treated in a protective manner; see U.S. Pat. No. 3,760,750 for example.

The stages discussed above accumulate a great deal of cost, notably, the large oven and large heat in-put, the wickets and the attendant transport equipment, the heat loss and thermal stress caused by repetitious cooling and heating of the wickets as they leave and re-enter the oven, sheet registration difficulty, and extra resin to compensate for imperfections, among others. The primary object of the present invention is to eliminate these cost factors, to separately obtain an increase in productivity from an exceptional bonding resin, to protect the raw edge as an incident to applying the bonding resin and to attain, for what is believed to be the first time, a cement lap seam in which the area of the bonding resin is substantially the same as the area of the opposed adhesive and certainly no more than the slight tolerance allowance required for the overlap side seam.

Specifically it is an object of the present invention to first obtain the body blanks and afterwards size and cure, preferably by applying the bonding resin in a thin film to a moving stream of the body blanks and initiating the resin cure in less than a second.

Another object of the present invention is to attain a minimum area of bonding resin in minimum thickness and to avoid the necessity of oven baking a large sheet by sizing pre-cut body blanks in a moving stream with a resin which can be cured in less than a second by an intense flame prevailing in the production stream immediately adjacent the resin size treatment. A related object is to enable an exceptionally fast cure, and thin film size to be obtained by employing bisphenol formaldehyde as the bonding resin.

Figures 1, 2, 3:
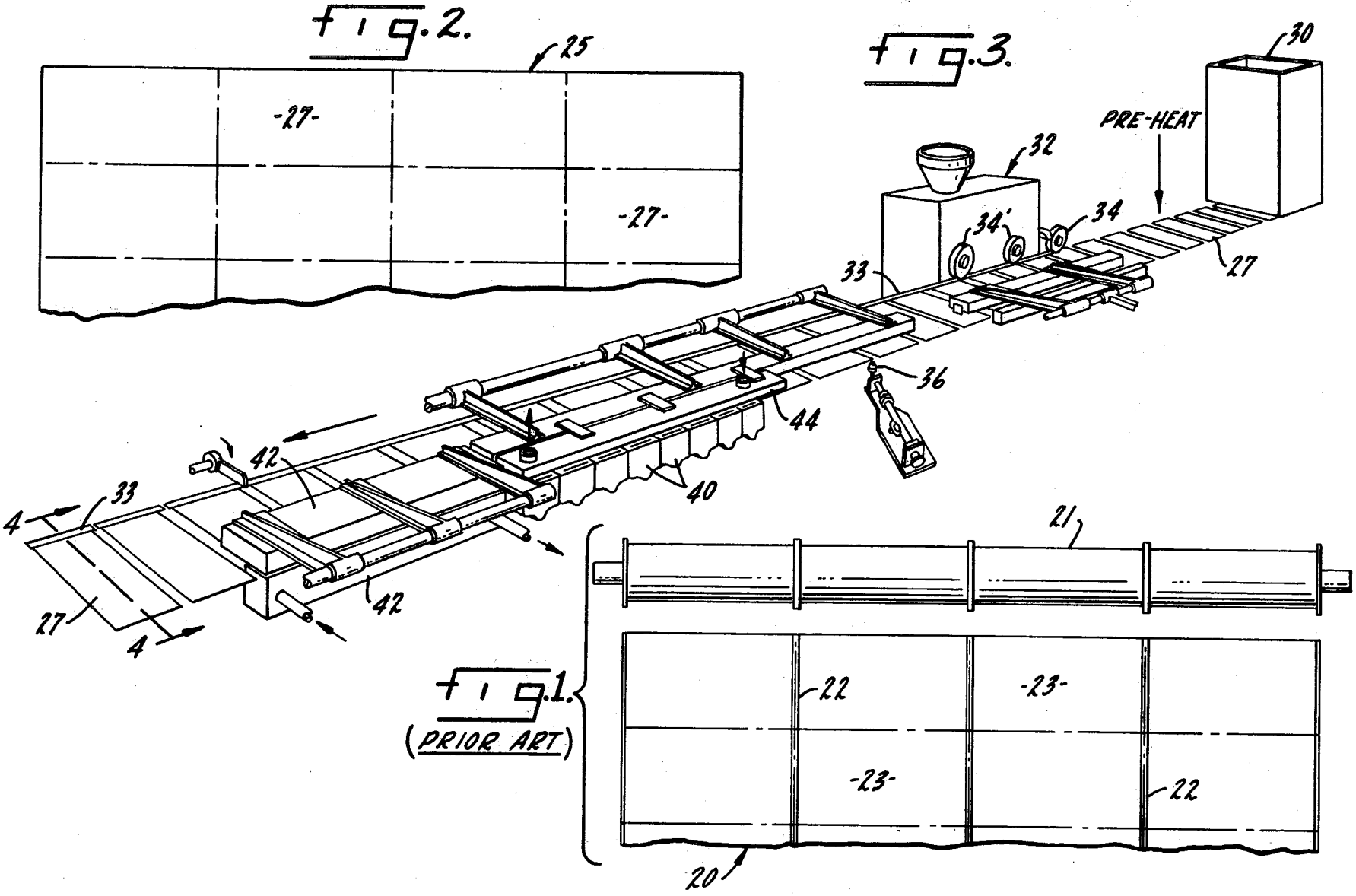
FIG. 1. (PRIOR ART)
FIG. 1 is a diagram of certain prior art practices.
FIG. 2 is a diagram showing the development of body blanks under the present invention.
FIG. 3 is a schematic perspective view of apparatus employed in one mode of practice under the present invention.

Previous practice is exemplified by FIG. 1. A large sheet 20, from which the body blanks are cut, is sized by a sizing roller 21 which applies the bonding resin in stripes 22. The sheet is cured in an oven as already mentioned requiring, for example, an eight minute bake at 390° F after which the sheet is cut (dashed lines) by opposed disc cutters separating the body blanks 23. There are intervening steps, before cutting, involving inversion of the sheet to apply a bondable protective coating on the reverse side, as viewed in FIG. 1, and reinversion for lithographic application of the decorative face, of no concern to the principles of the present disclosure.

Under the present invention the starting sheet 25, FIG. 2, is not sized with a bonding resin; instead, body blanks 27 having no pre-applied bonding size are separated in the customary fashion and these body blanks are employed at the commencement of the production stream.

The starting sheet material 25 may be the conventional low carbon steel, preferably plated with chromium, specified as suitable for the product involved. A sheet about three feet on a side may be used, coated on the face constituting the inside of the can body with an organic coating in accordance with the disclosure of U.S. Pat. No. 3,773,589. This inside surface is capable of bonding to a super polyamide adhesive strip which itself will not bond to bare metal. The other face of the starting sheet bears no coating; this face will receive the bonding resin, bonded directly to the bare metal.

The organic coating applied to the inside of the container body is disclosed in U.S. Pat. No. 3,773,589 (incorporated by reference herein) being the heat product of from 1 to 8 and preferably about 4 parts (by weight) of a polyvinyl acetal resin; from 50 to 90 and preferably about 70 parts of a 1,2-epoxide resin; from 5 to 50 and preferably about 25 parts of a methylol phenol resin; and from 0.2 to 2.0 and preferably about 0.6 parts of an aliphatic amine phosphate acid salt. The coating is applied as a solution or dispersion of the above described ingredients, before their inter-reaction, in a fugitive liquid. The solution method is preferable, and the particular liquids, whether solvents or dispersants, are not especially critical. It is necessary, however, that the liquid be volatile at baking temperatures which may be as low as 350° F or as high as 650° F. At the lower temperature a baking period of about 20 minutes may be required and at 650° F a time of 15 seconds may suffice.

The preferred organic coating thus applied to the inside of the container body may be the specific example of the aforesaid patent:

| Ingredient | Parts by Weight |
|---|---|
| Epon (1,2 epoxide resin) | 70.0 |
| 1-allyloxy-2,4,6-trimethylolbenzene | 26.0 |
| polyvinyl butyral containing about 12% polyvinyl alcohol | 4.0 |
| mono (dibutylamine) pyrophosphate | 0.5 |
| tolune | 100.0 |
| butanol | 70.0 |

Equivalents may be used since the essential requirement is that the container have a surface to which the adhesive will bond.

The body blanks 27 are to be processed in a stream, FIG. 3, and for this purpose they may be stacked in a suitable supply hopper 30, with the coated side up. The blanks are fed sequentially from the supply station on to a conveyor, not shown. They are then pre-heated to about 450° F, on the far margin as viewed in FIG. 3, and advanced in sequence past an extruder assembly 32 where a hot polyamide adhesive in ribbon form is applied continuously to the pre-heated lap margin, thereby bonding to the coated surface identified above. The polyamide adhesive need be no wider than 0.200 of an inch and is of the kind disclosed in U.S. Pat. No. 3,773,589 characterized by having recurring aliphatic amido groups separated by alkylene groups having at least two carbon atoms and an intrinsic viscosity of at least 0.4. Specifically the linear superpolyamide may be poly-11-aminoundecanoic acid, but there are many equivalents listed in the patent; superpolyamide MIL-VEX 1235 may be used as well.

The polyamide adhesive ribbon 33 is extruded on to a roller 34 which applies the ribbon 33, subsequently ironed and cooled by a series of rollers 34' resulting in tight bonding between the adhesive and the organic coating 35, FIG. 4, previously applied to the sheet 25 from which the body blanks 27 are cut.

Figure 4:
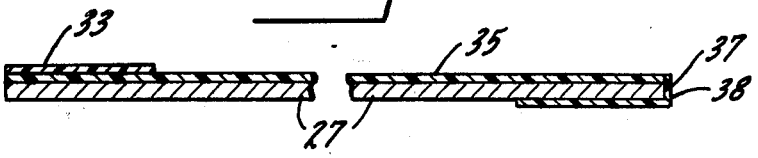
FIG. 4 is a sectional view of a body blank produced under the present invention, taken on the line 4—4, FIG. 3.

At a subsequent station, FIG. 3, the opposite lap margin of each body blank is sized with the bonding resin, preferably applied by a spray applicator nozzle 36 so positioned and adjusted that the resin size is limited to the minimum area and thickness required for an effective side seam bond; at the same time the free edge 37 of blank 27, FIG. 4, may be protected by the same bonding resin film 38.

Under and in accordance with the present invention the bonding resin is bisphenol formaldahyde or it may be a 50—50 mixture (by weight) of bisphenol formaldahyde with a 50—50 mixture of (a) the condensation polymer of epichlorhydrin and (b) bisphenol A, dissolved in a suitable solvent. The two are deemed equivalent for the purpose of bonding to the super linear polyamide adhesive. It will be recognized that proportions are not critical nor is the solvent for the resin critical except a non-sooting solvent is preferred such as butyl cellosolve.

Employing a 15% solution (resin solids by weight) and with the conveyor moving blanks at a speed of about 240 feet per minute, the spray applicator is so adjusted as to apply a minimum resin size thickness of about 2 to 4 milligrams per four square inches, or a thickness of no more than about 0.00001 to 0.00004 of an inch, that is, from one hundredth to four hundredths of a mil thick.

The resin size is immediately subjected to an initial cure (insoluble in methyl ethyl ketone) and this is accomplished by a battery of flame burners 40 (eight in number over a span of 24 inches) so positioned as to direct an intense flame against the restricted lap margin area to which the bonding resin size has been applied. The exposure of each body blank to the intense flame is no more than about ½ second, the temperature of the lap margin reaching approximately 500°–550° F. In spite of this high temperature, degradation of the resin has not been observed in actual practice. This is believed due partly to the thin size coat in conjunction with the remainder of the body blank serving as a large heat sink, rapidly conducting heat away from the lap margin where the resin is undergoing cure. The resin, as noted, should be capable of being cured to ketone insolubility in less than a second at 500°–550°. The preferred resin size is VARCUM 8357 bisphenol formaldehyde (dissolved in butyl cellosolve) having the following characteristics:

| | |
|---|---|
| Specific Gravity | 1.210 – 1.220 |
| Capillary Softening Point | 50 – 60° C |
| Hot Plate Cure at 150° C | 120 – 180 sec. |
| Viscosity (60% solids in alcohol) | 75 – 150 cps. |
| Weight Loss: | |
| at 250° F | 4 – 6% |
| at 700° F | 26 – 32% |
| Reactivity (melting point of 4:1 mixture with gum rosin; measures combined formaldehyde.) | 121 – 125° |
| Solubility: | |
| Soluble in alcohols, esters and ketones. | |

To cool the resin size and remove tackiness originated as a result of the initial cure, the body blanks, still joined by the adhesive ribbon, are moved in sequence past and between chill blocks 42. The body blanks are pressed momentarily against the underside of the chilled, upper block 42 (by means of an air jet, not shown) and in this connection it may be noted that a water cooled rail 44 may be positioned on the top side of the body blanks as they traverse the resin size curing station.

Following the chill of the resin size, a cutter, not shown, separates the adhesive ribbon between body blanks. The separate body blanks are now free to be formed into cylindrical shape, such as in the manner disclosed in U.S. Pat. No. 3,481,809, by roll forming the blank around a mandrel and subsequently the resin size is reheated to a temperature of about 550° F concurrently with activating the polyamide adhesive by heating it to about 300° F, establishing the conditions for final cure, whereupon the margins may be lapped and pressed into intimate contact to complete the side seam bond. The seam is then chilled resulting in a permanently bonded open-ended tubular body which may be flanged (or necked down) and thereby conditioned to accept the bottom and top closure members.

Increased productivity under the present invention is considerable. A thick resin size is not needed and careful application by a long sizing roller, applying the resin size in multiple stripes, is no longer required. The oven bake, becomes obsolete, along with the capital cost of the attendant equipment. If the raw edge is not always adequately protected by one spray nozzle 36, a second one may be employed for assurance. It may be possible to locate the burners 40 immediately upstream of the size nozzle 36 rather than downstream since the essential requirement is simply that the body blank be at a temperature (500° - 550° F) where the resin size will initially cure to ketone insolubility in less than one second. Two known resin formulations are given. Aluminum may be used for the body blanks, as is well known, and induction heating may be used rather than flame heating.

Figure 5:
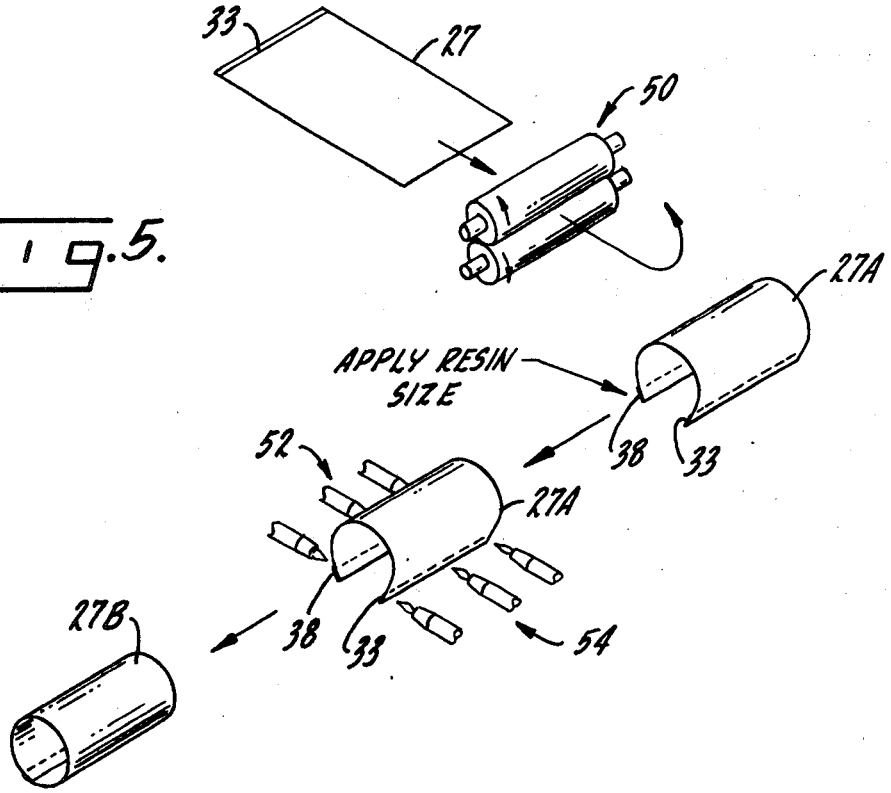
FIG. 5 is a view of another mode of practicing the invention.

Resin sizing and one stage resin cure (rather than two stage aforesaid) may be accomplished at the production stage shown in FIG. 5, where the flat body blank 27, bearing the adhesive strip 33 is roll formed on a mandrel 50. The body blank then has a permanent set in the form of a cylindrical or curved body blank 27A with the margins to be lapped spaced an inch or so radially. Enough space between the separated edges is presented to enable the resin size to be applied in the limited weight (2 to 4 milligrams per four square inches) and restricted area (0.200 of an inch) referred to above. In this mode of practice, the raw edge is in a position more susceptible to being covered by the resin size spray. The adhesive strip 33 (superpolyamide, identified above) will have already been applied to the flat body blank in the manner shown in FIG. 2. The MILVEX superpolyamide referred to above is defined in the main claims of U.S. Pat. No. 3,645,932 and Re. 27,748.

The size, after roll forming the body blank 27A, FIG. 5, is heated in one step to the final cure temperature, as by flame burners 52, FIG. 5, and concurrently the polyamide adhesive strip is heat activated, as by flame burners 54, to a temperature where it will readily bond to the heat activated resin size 38. The lap margins are mated and then permanently united by the conventional "bump" step, as it is termed in the art, to complete the side seam for the tubular shell 27B. In this mode of practice the resin is not heated to initiate a preliminary cure.

In both modes of practice, spray application of the resin size, based on present experience, is preferred to sizing by means of a narrow width roller (0.200 of an inch) because the raw edge is easier to cover by a sprayed resin and there seems to be more assurance of uniform coverage by the resin size in the minimum weight and area desired.

We claim

1. A method of producing a sheet metal container body having opposed longitudinal margins overlapped to form a bonded lap side seam, comprising the following steps starting with a pre-cut body blank having one side with a surface to which a bonding resin will bond and having a surface on the other side to which an adhesive will bond:

A. applying to the lap margin of the body blank on said one side a bonding resin size in an area limited to substantially no more than the area of the lap seam, said bonding resin being one which may be initially cured by heat and which attains a stage of final cure when re-heated;

B. heating the body blank substantially in the restricted area of the resin size to a temperature which will initially cure the resin;

C. applying said adhesive to the lap margin of the body blank at said other side, said adhesive being one which attains a stage of activation in the presence of heat and in that stage will bond to the resin; and D. pressing the lap margins together under conditions of final cure for both the resin and adhesive to complete the bonded seam.

2. The method of claim 1 in which the bonding resin is spray applied.

3. The method of claim 2 in which the resin is also applied to the adjacent cut edge of the pre-cut body blank.

4. The method of claim 1 in which said other surface is presented by the heat reaction product of:

a. polyvinyl acetal resin, b. 1, 2 epoxide resin, and a c. methylol phenol resin and in which the adhesive is a polyamide characterized by recurring aliphatic amido groups separated by alkylene groups having at least two carbon atoms.

5. The method of claim 4 in which the bonding resin is selected from the group consisting of (a) bisphenol formaldehyde and (b) a mixture thereof with a condensation polymer of epichlorhydrin and bisphenol-A, capable of initially curing to ketone insolubility in less than one second at 500° - 550° F.

6. The method of claim 1 in which the starting body blanks are flat and are fed in a stream past an extrusion nozzel which applies to successive margins the adhesive as a continuous ribbon not more than about 0.200 of an inch wide, the bonding resin being spray applied in substantially the same width to the other lap margin as a solution of bisphenol formaldehyde, initial resin cure being effected by a battery of flame jets impinging on the restricted resin size area so that the remainder of each body blank serves as a heat conductor, and including the steps of:

E. engaging each body blank successively with a chill surface to cool the initially cured bonding resin; and F. severing the adhesive ribbon in the portion between body blanks.

7. The method of claim 6 in which said other surface is presented by the heat reaction product of:

a. polyvinyl acetal resin, b. 1, 2 epoxide resin, and a c. methylol phenol resin and in which the adhesive is a polyamide characterized by recurring aliphatic amido groups separated by alkylene groups having at least two carbon atoms.

8. A method of producing a sheet metal container body having opposed longitudinal margins overlapped to form a bonded lap side seam, comprising the following steps starting with a pre-cut body blank having one side with a surface to which a bonding resin will bond and having a surface on the other side to which an adhesive will bond:

A. applying to the lap margin of the body blank on said one side a bonding resin size in an area limited to substantially no more than the area of the lap seam, said bonding resin being one which attains a stage of final cure when heated;

B. heating the body blank to a temperature which will cure the resin;

C. applying said adhesive to the lap margin of the body blank, said adhesive being one which attains a stage of final activation in the presence of heat and in that stage will bond to the resin; and D. pressing the lap margins together under conditions of final cure for both the resin and adhesive to complete the bonded seam.

9. The method of claim 8 in which the body blank is formed to cylindrical form when the bonding resin is applied.

10. The method of claim 9 in which the resin is also applied to the adjacent cut edge of the pre-cut body blank.

11. The method of claim 8 in which said other surface is presented by the heat reaction product of:

a. polyvinyl acetal resin, b. 1, 2 epoxide resin, and a c. methylol phenol resin and in which the adhesive is a polyamide characterized by recurring aliphatic amido groups separated by alkylene groups having at least two carbon atoms.

12. The method of claim 11 in which the bonding resin is selected from the group consisting of (a) bisphenol formaldehyde and (b) a mixture thereof with a condensation polymer of epichlorhydrin and bisphenol-A, capable of curing to ketone insolubility in less than one second at 500° – 550° F.

13. A container having a tubular metal wall with a bonded lap side seam obtained by bonding a polyamide adhesive strip and a stripe of heat cured resin size in juxtaposition, the predominate active ingredient in the resin size being bisphenol formaldehyde applied directly to the metal constituting said wall and to the free edge of metal at the inside of the seam without intervention of another material between the resin size and the metal or between the polyamide adhesive and the resin size.

14. The container of claim 13 in which the resin size has a thickness which is a fraction of a mil.

15. The method of forming a bonded lap side seam in a cylindrical shell obtained from a metal body blank having lap margins to be juxtaposed and joined and comprising, presenting between the juxtaposed lap margins a strip of polyamide adhesive supported on one side of the blank, and a stripe of resin size bonded directly to the metal on the opposed surface of the body blank and also bonded directly to the adjacent free metal edge without intervention of another material therebetween, said adhesive and resin being bondable to one another, activating each strip by heat to a bondable state and pressing the adhesive and resin together to complete the bond, the resin size being one selected from the group consisting of (a) bisphenol formaldehyde and (b) a mixture thereof with a condensation polymer of epichlorhydrin and bisphenol-A.

* * * * *